US005145421A

United States Patent [19]

Julian

[11] Patent Number: 5,145,421

[45] Date of Patent: Sep. 8, 1992

[54] CABLE CONNECTOR

[76] Inventor: Kenneth A. Julian, 409 Suffolk La., Oak Brook, Ill. 60521

[21] Appl. No.: 734,438

[22] Filed: Jul. 23, 1991

[51] Int. Cl.[5] ..... H01R 4/30

[52] U.S. Cl. ..... 439/801

[58] Field of Search ..... 439/754, 755, 801, 883

[56] References Cited

U.S. PATENT DOCUMENTS 3,413,593 11/1968 Schaefer ..... 439/754 X
3,775,730 11/1973 Rowls et al. ..... 439/755 X
3,992,075 11/1976 Cannarsa ..... 439/755
4,936,749 6/1990 Woodall ..... 439/754 X

*Primary Examiner*—Eugene F. Desmond
*Attorney, Agent, or Firm*—Edmond T. Patnaude

[57] ABSTRACT

A cable connector for attaching a cable having stranded wires enclosed in an insulated enclosure has a metal plate attached to the stranded wires. A threaded bolt is passed through an aperture in the metal plate and held in position by a nut. The parts, with the exception of the portion of the threaded shank extending beyond the nut, and the outer surface of the nut are hermetically sealed in an insulating enclosure. Finally a malleable sleeve of conductive material is fitted over a portion of the uncovered threaded shank of the bolt. When the shank of the bolt and the sleeve are passed through an aperture in a bulkhead or other conductor member, and a nut tightened on the end of the bolt projecting through the conductor member, the malleable sleeve is longitudinally compressed causing it to radially expand within the aperture in the conductor member.

6 Claims, 1 Drawing Sheet

CABLE CONNECTOR

This invention relates in general to electrical connectors for connecting an insulated wire to a conductive member, and in particular it relates to a sealed connector having a threaded stud adapted to be inserted through an aperture in a conductive member, such as a metal bulkhead or the frame of a vehicle, and held in place by a nut.

BACKGROUND OF THE INVENTION

Automobiles and other vehicles use high amperage current to operate the electrical systems thereof such as the starting system and the like. The electrical systems for such vehicles generally provide for one terminal of each system to be connected by insulated wiring to one terminal of the battery and the other terminal of each system to be connected to the frame of the vehicle as a ground. The frame itself is connected by a cable to the other terminal of the battery. All the electrical systems of the vehicle are, therefore, dependent upon the frame of the vehicle being connected to the battery and to the electrical system by good, low resistance connections. In the event the electrical ground connections are defective, the electrical systems will be adversely affected.

In the past it has been the practice to connect the frame of a vehicle to an associated ground terminal by means of a cable having stranded wires enclosed in an insulating material attached to a flat plate having an aperture therein. A bolt passed through a hole drilled in an appropriate position on the frame was used to attach the cable to the frame. The prior art type connectors may fail to make a good, low resistance electrical connection to the frame of the vehicle, especially when the mounting member and the aperture therein through which the connecting bolt is passed have been painted. Furthermore, the bolt, the metal plate, and the vehicle frame in the vicinity of the connector are all typically made of steel or other metal alloy which is subject to corrosion and other deterioration. Deterioration can, over a period of time, result in the build up of non-conducting material between the cable connector and the frame and ultimately result in the reduction of electric power to the components of the vehicle resulting from an increase in the resistance in the electrical systems. Ultimately, the connecting cable may need to be replaced. Furthermore, if the frame surrounding the aperture through which the bolt is passed has deteriorated, it may be necessary to drill a new hole in the frame and attach the ground cable to an entirely different portion of the vehicle.

In addition to the above, prior art connectors are not insulated and project outwardly from the bulkhead or other mounting member of the vehicle and create a danger if contact is made with any electrical components wired to the hot terminal of the battery.

It is, therefore, desirable to provide a cable connector which will make a good electrical contact with the frame of a vehicle, and provide a sealed covering around the vicinity of the connection so as to protect the cable termination, the connecting bolt and the frame in the area of the contact from exposure to the ambient, and contact with other components of the vehicle.

SUMMARY OF THE INVENTION

Briefly, one aspect of the present invention is embodied in an improved connector suitable for attaching an insulated cable of stranded wire to the frame of a vehicle or other member. The invention includes a threaded stud, one end of which is attached to the stranded wires. In the preferred embodiment, the threaded stud is the end of a bolt, and the stranded wires are attached to a planar metallic plate. The bolt is passed through an aperture in the metallic plate and held securely therein by a nut on the opposite side thereof. The head of the bolt, the outer perimeter of the nut, the plate, and a portion of the insulated cable are all hermetically sealed in an insulating material.

The preferred embodiment further includes a sleeve of malleable conductive material, the inner surface of which is threaded complementary to the threads of the bolt, and the sleeve has a length less than the length of the portion of the bolt which extends beyond the nut. The connector is adapted to be mounted in an aperture in an electrically conductive member such as a metal bulkhead or the metal frame of a vehicle which has a diameter slightly larger than the outer diameter of the sleeve. When a nut is tightened onto the stud to secure the connector to the frame, the sleeve is longitudinally compressed and expands radially to make a good, low ohmic connection to the wall of the aperture in the frame.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT OF THE INVENTION

Figure 3:
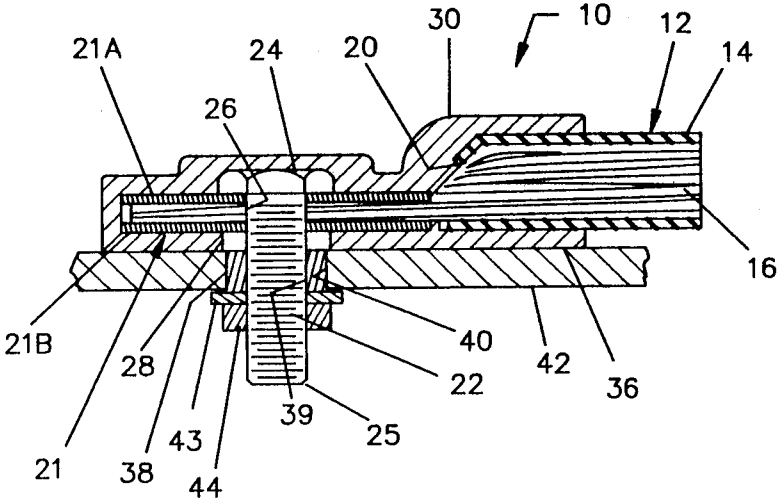
FIG. 3 is a cross-sectional view of the electrical connector shown in FIG. 1 attached to a conductive member and showing the malleable sleeve compressed against the inner walls of an aperture in a conductive mounting member.
Figure 2:
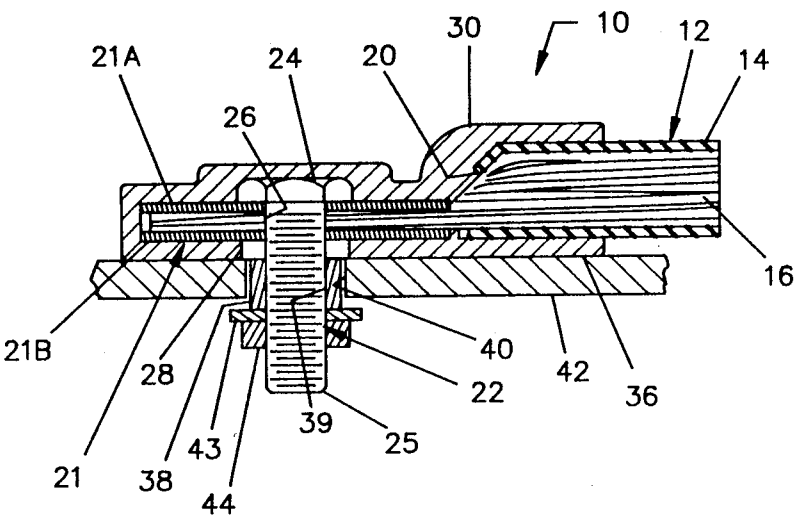
FIG. 2 is a cross sectional view of the electrical connector shown in FIG. 1 attached to a conductive member prior to compressing the malleable sleeve.
Figure 1:
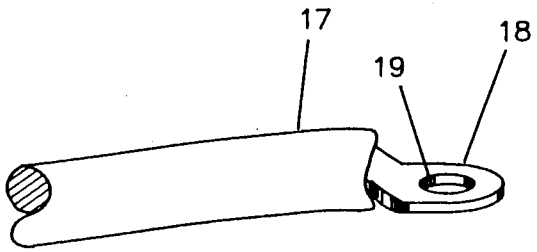
FIG. 1 is an isometric view of a cable having a connector embodying the present invention.
Figure 1:
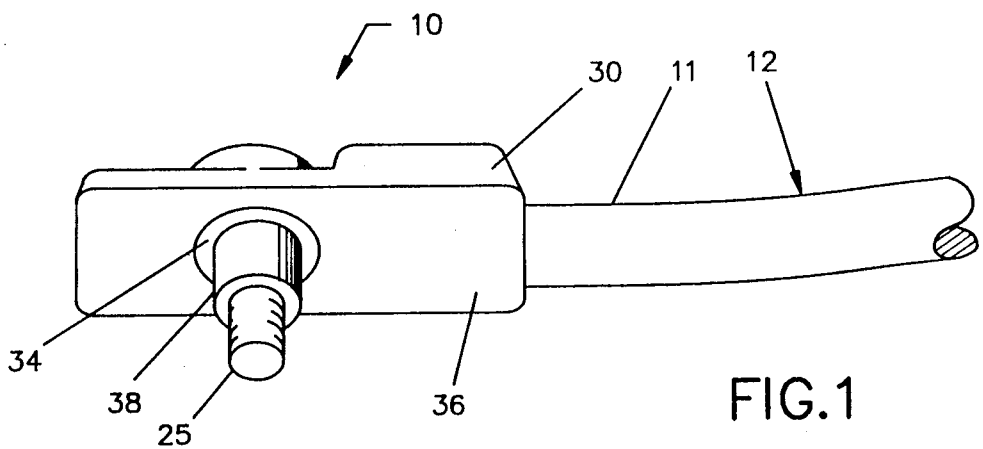

Referring to FIGS. 1, 2 and 3, an electrical connector is attached to one end 11 of an electric cable 12 having an insulated cover 4 surrounding a plurality of stranded wires 16. The opposite end 17 of the cable 12 is fitted with a metal plate 18 soldered to the strands of wires 16, and an aperture 19 in the plate 18 permits the opposite end 17 of the cable 16 to be attached to en electrical system of the vehicle, not shown. The strands of wire 16 extend beyond the distal end 20 of the insulated cover 14, and are compressed between upper and lower metallic plate members 21A, 21B respectively. The end portions of the strands of wire 16, the upper plate 21A and lower plate 21B are all compressed and soldered together to form a single plate 21.

A threaded bolt 22 having a head 24 and a stud 25 is passed through an aperture 26 in the plate 21 and secured by a nut 28 fitted over the stud 25. The bolt head 24, the plate 21, the end of the cover 14, and a portion of the cable 12 are all covered by a resilient insulating enclosure 30 to hermetically seal the metal parts from the ambient and leave exposed only a portion of the stud 25 of the bolt 22 and the annular surface 34 of the nut 28 which faces away from the bolt head 24. It should be noted that the insulating enclosure 30 has a substantially planar surface 36 which is coplanar with the annular surface 34 of the nut 28.

There is further provided in accordance with the present invention a sleeve 38 made of an appropriate malleable material such as lead, copper, brass, or the like which is electrically conductive. The length of the sleeve 38 is less than the length of the portion of the shaft 25 of the bolt 22 which extends beyond the nut 28. The inner surface 39 of the sleeve 38 has threads complementary to the threads of the stud 25 to hold the sleeve in assembled relationship with the stud during mounting of the connector to the frame or a bulkhead of a vehicle.

The distal end of the stud 25 including the sleeve 38 is adapted to be inserted into an aperture 40 in a mounting member 42 of the frame of a vehicle. The stud 25 is retained therein by a lock washer 43 and a retaining nut 44, which are fitted over the distal end of the stud 25 extending out of the opposite side of the mounting member 42 to which the connector 10 is attached. As the retaining nut 44 is tightened onto the stud 25, the malleable sleeve 38 will be compressed and will expand against the inner surface of the aperture 40 in the mounting member 42 of the vehicle to make a good electrical contact to the mounting member 42 as shown in FIG. 3. Furthermore, any portion of the sleeve 38 which extends through the far side of the mounting member 42, will be compressed around the outer perimeter of the aperture and further retain the connector 10 within the aperture 40.

When the connector 10 is attached to a mounting member 42, such as a bulkhead of a vehicle, and the retaining nut 44 tightened, the planar surface 36 of the insulting enclosure 30 surrounding the nut 28 will seal against the mounting member 42 and thereby protect the sealed parts from the ambient.

A connector 10 in accordance with the present invention is best made by removing the cover material 14 from the ends of the strands of wire 16. The wires are then enclosed within a piece of metallic tubing which is then flattened over the wires 16 for form the upper and lower plate members 21A, 21B respectively. Thereafter, an aperture 26 is drilled through the center portion of the plate 21 and the bolt 22 is passed through the aperture 26 and held in position by a nut 28 fitted over the stud 25 of the bolt 22. The parts, with the exception of the exposed portion of the stud 25 of the bolt 22 and the annular surface 34 of the nut 28 are then potted in the insulating enclosure 30. Finally, a sleeve 38 having threads in the interior surface 39 complementary to the threads of the bolt 22 is tightly threaded onto the bolt 22. The threads in the inner surface of the sleeve 38 enable the sleeve to be easily stored and retained with the connector 10 until utilized. Accordingly, there is provided a cable termination suitable for attachment to a planar mounting member of a vehicle which can be hermetically sealed against the surface of the mounting member of the vehicle.

While the present invention has been described in connection with one embodiment, it will be apparent to those skilled in the art that many changes and modifications may be made without departing from the true spirit and scope of the present invention. Therefore it is the intent of the appended claims to cover all such changes and modifications which come within the true spirit and scope of the invention.

What is claimed:

1. An electrical connector for attaching a cable of stranded wires surrounded by an insulating material to an electrically conductive member having an aperture therein having a first given length comprising in combination:

a threaded stud having an outer diameter which is less than the diameter of said aperture and two ends separated by a second given length which is longer than said first given length, attachment means for attaching one of said ends of said threaded stud to said strands of wire, an insulating covering material which covers said one of said ends, said attachment means and a portion of said insulating material, and an electrically conductive sleeve of malleable material fitted over said stud and having an outer diameter less than the diameter of said aperture and a length less than said length of said stud and greater than said length of said aperture.

2. An electrical connector in accordance with claim 4 further comprising:

a flattened conductive tube surrounding a portion of said stranded wire from which said insulating material has been removed and further having an aperture in said flattened tube, and said threaded stud is the stud of a bolt which has been passed through said aperture in said flattened tube.

3. The combination comprising:

a cable comprising a plurality of stranded wires, an electrical connector having a threaded stud with two spaced apart ends, one of said ends connected to said plurality of stranded wires, an insulating material which covers a portion of said stranded wires and said one of said ends leaving uncovered the other of said ends, a sleeve of malleable conductive material fitted over said other of said ends, and a conductive member having an aperture therein through which said other of said ends and said sleeve are passed and retained therein by a nut threaded onto said other of said ends of said stud.

4. The combination in accordance with claim 3 wherein said sleeve has interior threads which are complementary to the threads of said stud.

5. A method of attaching a cable having a plurality of strands of wire surrounded by an insulated cover to a conductive member having an aperture therein, comprising the steps of:

attaching a portion of said strands of wire to one end of a threaded stud having a central portion and two spaced apart ends, positioning an electrically conductive malleable sleeve around said central portion of said threaded stud, said sleeve having a length less than that of said stud leaving a portion of said stud extending from said sleeve, inserting said stud and said sleeve into said aperture in said conductive member having a length less than that of said sleeve, and tightening a nut having threads complementary to said threads of said stud onto said stud so as to compress said malleable sleeve longitudinally and cause said malleable sleeve to expand radially within said aperture in said conductive member to provide a tight fit between said sleeve, said stud and said conductive member.

6. An electrical connector for attaching a cable of stranded wires surrounded by an insulating material to an electrically conductive member having an aperture therein having a given length comprising in combination:

a threaded stud having an outer diameter and two ends separated by a given length, attachment means for attaching one of said ends of said threaded stud to said strands of wire, an insulating covering material which covers said one of said ends, said attachment means and a portion of said insulating material, and an electrically conductive sleeve of malleable material fitted over said stud and having an outer diameter adapted to fit within said aperture, an inner diameter having threads complementary to said threaded stud, and a length less than said length of said stud and greater than said length of said aperture.

* * * * *

UNITED STATES PATENT AND TRADEMARK OFFICE

CERTIFICATE OF CORRECTION

PATENT NO. : 5,145,421

DATED : September 8, 1992

INVENTOR(S) : Kenneth A. Julian

It is certified that error appears in the above-identified patent and that said Letters Patent is hereby corrected as shown below:

In column 2, at line 47, after "cover" delete "4" and substitute -- 14--.

In column 4, at line 20, after "claim" delete "4" and substitute --1--.

Signed and Sealed this

Fourteenth Day of September, 1993

Bruce Lehman

*Attest:*

BRUCE LEHMAN

*Attesting Officer*

*Commissioner of Patents and Trademarks*